United States Patent [19]

Terkl

[11] Patent Number: 4,731,971

[45] Date of Patent: Mar. 22, 1988

[54] LARGE-PANEL COMPONENT FOR BUILDINGS

[76] Inventor: Hans-Ulrich Terkl, Edelackerstrasse 21, A-8642 St. Lorenzen i. Murztal, Austria

[21] Appl. No.: 28,792

[22] Filed: Mar. 23, 1987

Related U.S. Application Data

[62] Division of Ser. No. 653,361, Sep. 24, 1984, abandoned.

[30] Foreign Application Priority Data

Sep. 29, 1983 [DE] Fed. Rep. of Germany ..... 3335370
Dec. 21, 1983 [DE] Fed. Rep. of Germany ..... 3346277

[51] Int. Cl.[4] ..... E04B 2/54

[52] U.S. Cl. ..... 52/743; 52/309.12; 52/442; 52/79.11; 52/425; 264/35; 264/263

[58] Field of Search ..... 52/442, 251, 79.11, 52/425, 429, 569, 572, 100, 98, 424, 501, 570, 571, 309.12, 309.4, 743; 264/35, 241, DIG. 10, 263

[56] References Cited

U.S. PATENT DOCUMENTS

| | | | |
|---|---|---|---|
| 1,060,347 | 4/1913 | Massey | 52/251 |
| 1,185,969 | 6/1916 | Blackstone | 52/442 |
| 3,231,646 | 1/1960 | Conder et al. | 264/35 |
| 3,315,424 | 4/1967 | Smith | 264/35 |
| 3,390,494 | 7/1968 | Chappie | 52/105 |
| 3,768,225 | 10/1973 | Sloan | 52/743 |
| 3,788,020 | 1/1974 | Gregori | 52/309.12 |
| 3,885,296 | 5/1975 | Stout | 264/35 |
| 3,908,324 | 9/1975 | Stout | 52/309.16 |
| 4,229,922 | 10/1980 | Clark, Jr. | 52/442 |
| 4,234,634 | 11/1980 | Longinotti | 52/309.12 |
| 4,249,354 | 2/1981 | Wynn | 52/309.12 |
| 4,285,179 | 8/1981 | Goidinger | 52/309.12 |
| 4,338,759 | 7/1982 | Swerdlow et al. | 52/743 |
| 4,349,492 | 9/1982 | Shoham | 264/35 |
| 4,532,745 | 8/1985 | Kinard | 52/309.12 |

FOREIGN PATENT DOCUMENTS

| | | | |
|---|---|---|---|
| 76686 | 11/1953 | Denmark | 52/572 |
| 2324915 | 12/1974 | Fed. Rep. of Germany | 52/309.12 |
| 2447845 | 4/1976 | Fed. Rep. of Germany | 52/309.4 |
| 494404 | 9/1919 | France | 52/429 |
| 912658 | 8/1946 | France | 52/429 |
| 935740 | 6/1948 | France | 52/429 |
| 1085898 | 2/1955 | France | 52/251 |
| 722199 | 1/1955 | United Kingdom | 52/572 |

*Primary Examiner*—William F. Pate, III
*Assistant Examiner*—Caroline D. Dennison
*Attorney, Agent, or Firm*—Paul L. Sjoquist

[57] ABSTRACT

In the case of a large-panel component for buildings—which comprises at least two strip-shaped, juxtaposed panel elements made of light-weight concrete, said panel elements being provided with cavities which cross each other in the plane of the wall and with at least one semi-cavity which is provided on at least one end face and connection side, respectively, and said cavities forming a network and being adapted to be filled with cast concrete—the semi-panels defining the panel elements are provided with at least one semi-cavity, which extends in the longitudinal direction of said semi-panels, and with quarter-cavities, which extend parallel to said semi-cavity, both type of cavities being provided on the end faces and connection sides, respectively, of said semi-panels, and several semi-panels being interconnected, e.g. by glueing, such that they overlap one another in the longitudinal direction or, selectively, at least part of the cavities of the panel component being provided with a reinforcement in the manufacturing plant.

7 Claims, 12 Drawing Figures

Figure 1:
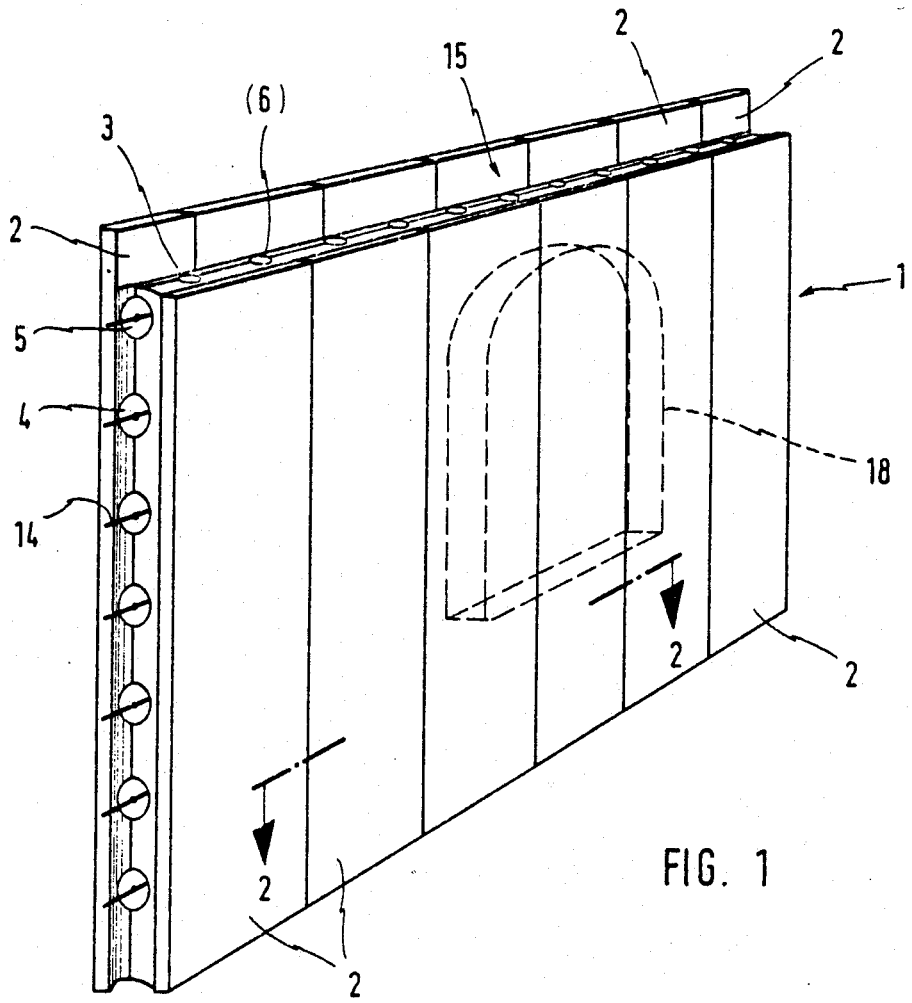

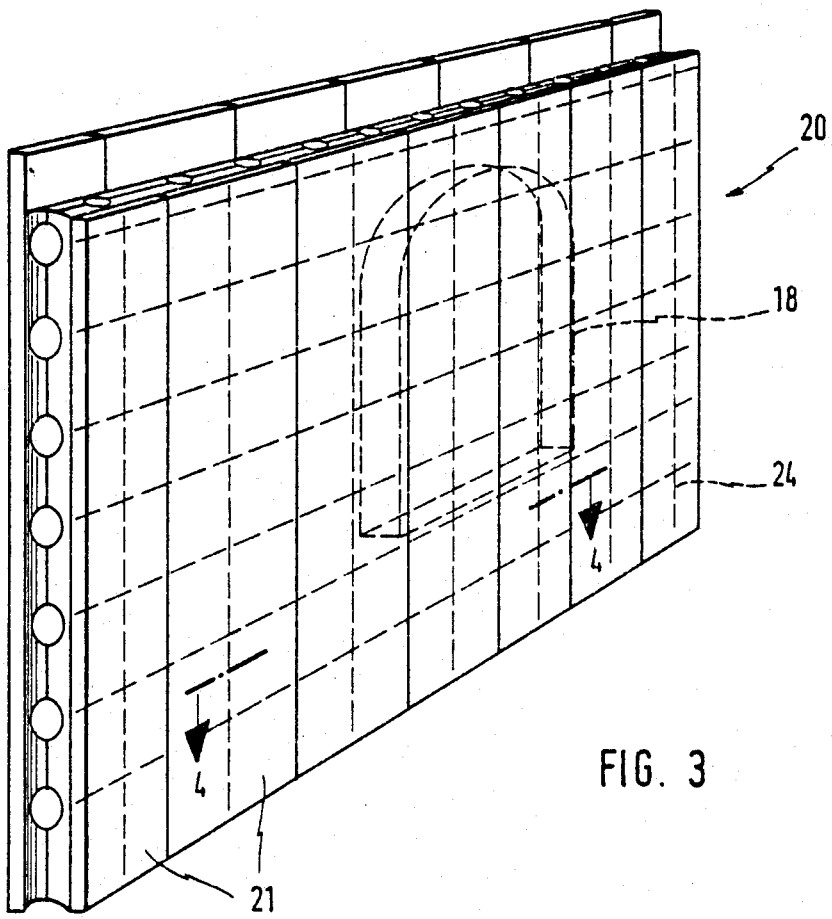
FIG. 3
FIG. 4
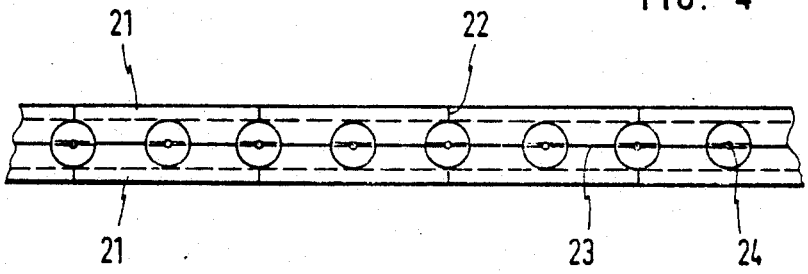

LARGE-PANEL COMPONENT FOR BUILDINGS

This is a divisional of co-pending application Ser. No. 653,361 filed on Sept. 24, 1984, now abandoned.

The present invention refers to a large-panel component for buildings, which comprises at least two strip-shaped, juxtaposed panel elements made of light-weight building material, in particular light-weight concrete, said panel elements being provided with cavities which cross each other in the plane of the wall and with at least one semi-cavity which is provided on at least one end face or rather on at least one connection side facing the neighbouring panel, and said cavities forming a network and being adapted to be filled with a filling material, e.g. with cast concrete.

The invention is based on the task of providing a large-panel component for buildings, which has the characteristics indicated hereinbefore and which can be produced comparatively simply and easily in a plant.

In accordance with an embodiment of the invention, this task is solved by the features that, on their end faces and connection sides, respectively, the semi-panels defining the panel elements are provided with at least one semi-cavity, which extends in the longitudinal direction of said semi-panels, and with quarter-cavities, which extend parallel to said semi-cavity, and that several semi-panels are interconnected, or rather glued together, such that they overlap one another in the longitudinal direction.

In view of the fact that the individual semi-panels are produced in the conventional manner with very small dimensional tolerances, it is now easily possible to join the large-panel components, e.g. on a table or on another flat surface, in which connection it is, of course, important that the respective semi-cavities and quarter-cavities of the individual semi-panels are brought into correspondence with one another so that subsequent formation of the network, which consists e.g. of a concrete core, can be carried out on-site (when the panel component has been erected) without any difficulties. The overlapping connection of the semi-panels does not only have the effect that possible cold bridges are avoided in the continuous joints extending transversely to the direction of the wall, but it also has the effect that the semi-panels can be joined—without any special technical expenditure—such that they are flush with one another.

The task indicated hereinbefore can also be solved by the feature that, in accordance with the invention, at least part of the cavities of the panel component are provided with a reinforcement in the manufacturing plant.

It is a matter of course that this can also be done when the semi-panels are interconnected in an overlapping manner.

In accordance with a preferred embodiment of the invention, the reinforcement consists, at least partially, of reinforcement cages, which are preferably provided with three longitudinal iron bars; the reinforcement can also consist of individual reinforcement iron bars held in their operative position by means of spacers.

The reinforcement iron bars influence the overall weight of the large-panel component only to a minor extent so that also the transport weight is increased only slightly. If necessary, it is also possible to fill the filling material, e.g. cast concrete, into the cavities in the manufacturing plant, whereby the stability and the static properties of the large-panel components for buildings will be influenced in a decisive manner. However, in particular in cases in which secondary treatment of the panel components has to be carried out in-situ it will probably be more expedient to insert the filling material in-situ.

In accordance with a preferred embodiment, the reinforcement iron bars are held together, e.g. by means of welding, in the form of a network. Preferably, such a reinforcement network should only be used in cases in which semi-panels are used, which are, as has been indicated hereinbefore, overlappingly interconnected, e.g. by glueing. When a layer of semi-panels is positioned side by side, e.g. on an assembly table, it may prove to be expedient that the spacers mentioned hereinbefore have a star-shaped structural design. The individual iron bars are thus arrested within the cavities approximately in the middle—a measure which will, however, impair only slightly the passability of the cavities for the filling material to be introduced on a later date.

An additional rationalization possibility in the case of the production of large-panel components for buildings is to be seen in the fact that recesses or blind recesses, openings or blind openings, or other treatment possibilities of the panel component are already provided in the manufacturing plant; for example, in the case of a large-panel component for buildings, which comprises at least one recess having e.g. the form of a window and extending partly or fully through said large-panel component, it is possible that the area of the recess is not provided with any reinforcement.

Above the recess or also above the blind recess, a reinforcement cage can be adapted to be inserted before the semi-panels are joined; this reinforcement cage can be used e.g. as a window or door lintel.

In accordance with a modified embodiment, the panel component is slotted and provided with a board or the like on the level of the upper edge of the recess or blind recess to be provided. In this case, the possible cutting out of the opening or recess or the milling out of the blind opening or blind recess can be dispensed with. In the case of this embodiment, the panel component can be provided with an aperture for filling the filling material into the cavities arranged below said aperture, said aperture being arranged on the level of the lower edge of the recess or blind recess to be provided. It is thus avoided that, in the case of a previous provision of a recess or blind recess and in the case of a blocking of the cavities at the upper edge and at the lateral edges, the cavities located below the lower edge must be filled completely with the filling material, e.g. cast concrete.

In accordance with a preferred modification a blind recess is provided and the exposed cavities are covered by laths or the like at least at the upper edge of the recess. Whether these laths are already mounted in the manufacturing plant or whether they are only mounted in-situ is of secondary importance; as has already been mentioned hereinbefore, these laths prevent the filling material from flowing into the recess when the cavities are being filled with said filling material.

In order to produce the effect which has just been mentioned, it will be expedient to cover all edges of the recess with laths, boards or the like.

Figure 2:
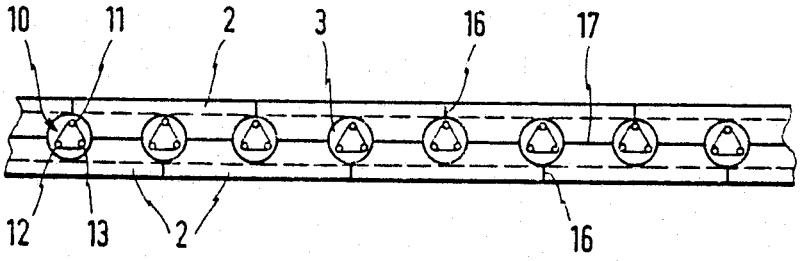
Figure 5:
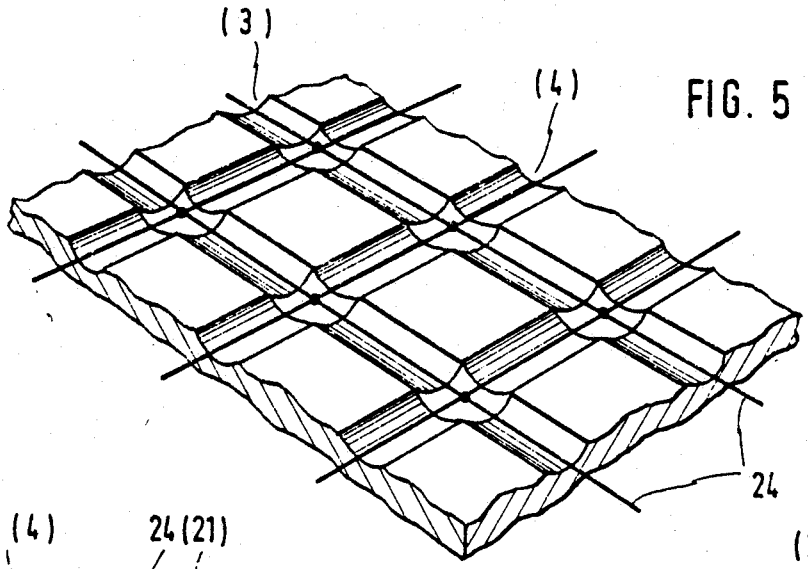
Figure 6:
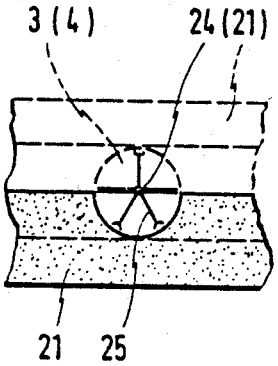
Figure 7:
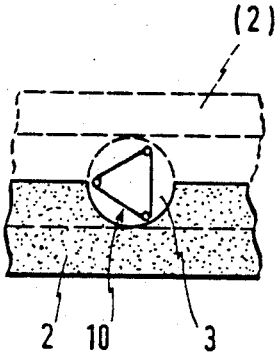
Figure 9:
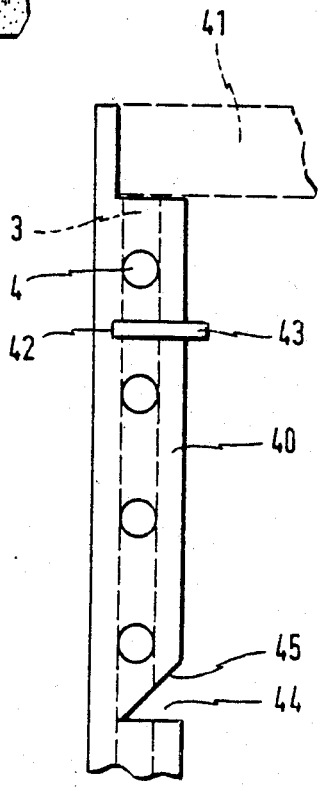
Figure 8:
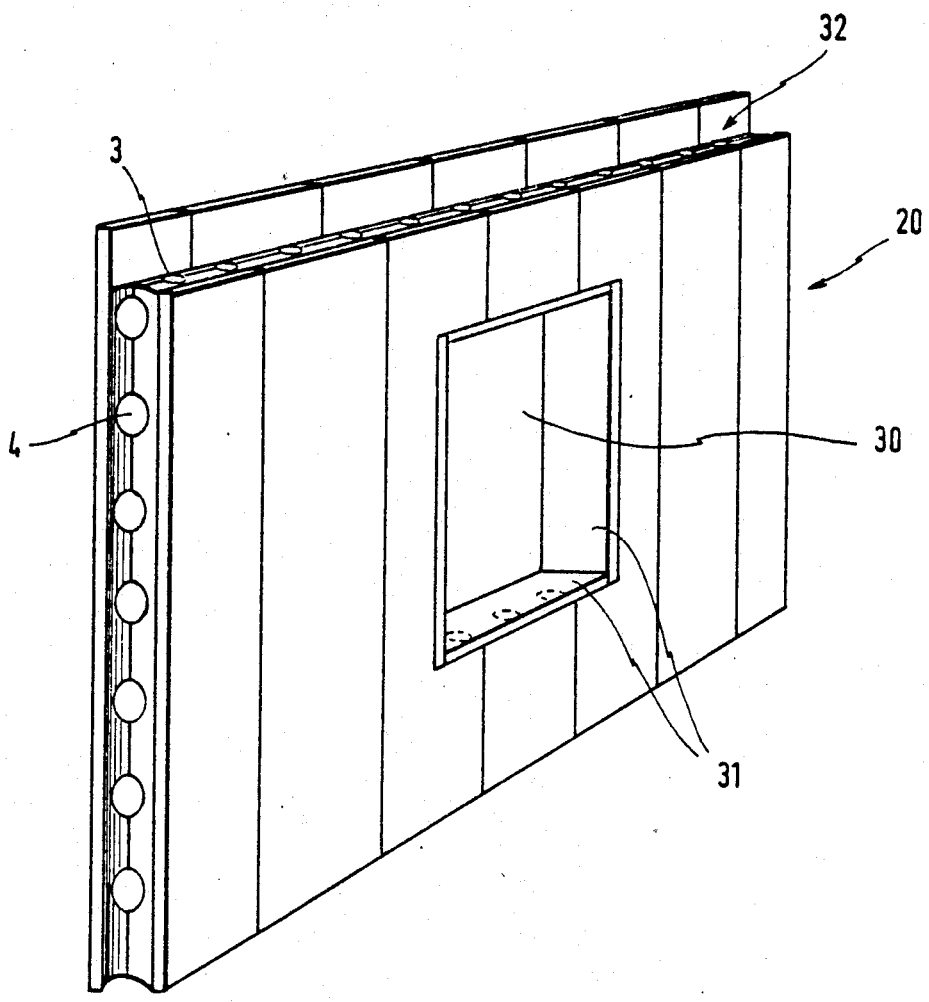
Figure 10:
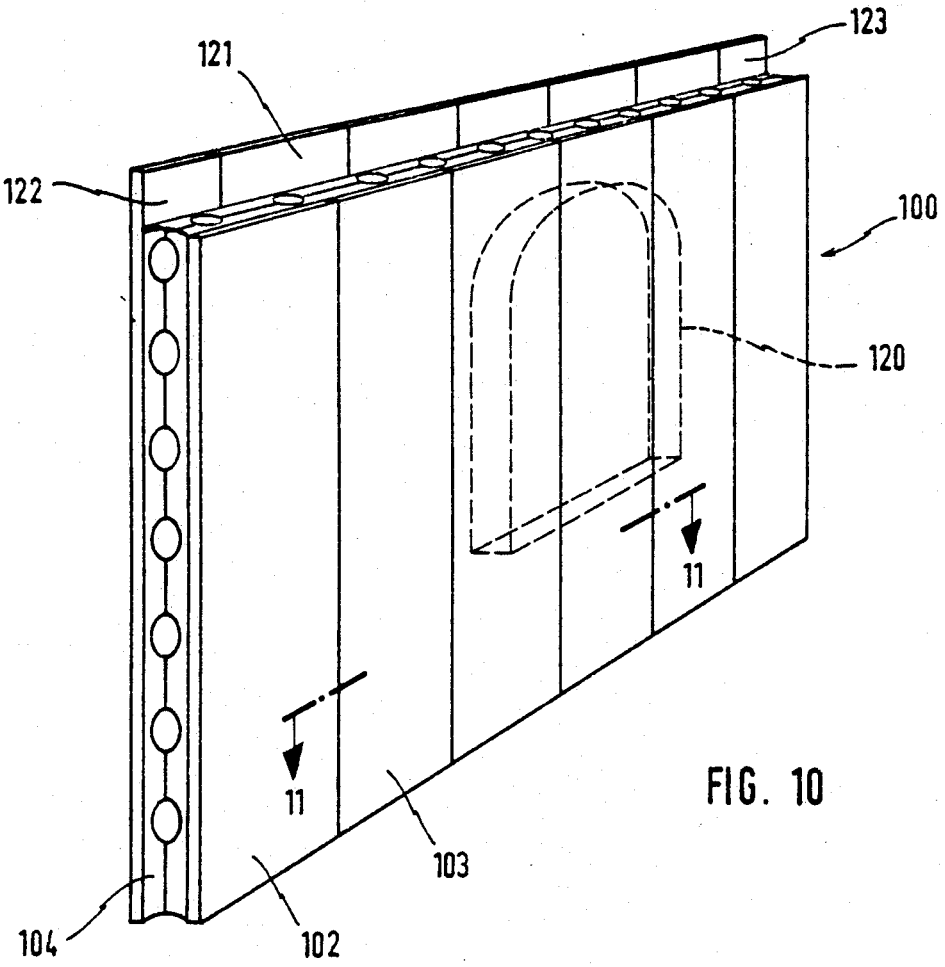
Figure 11:
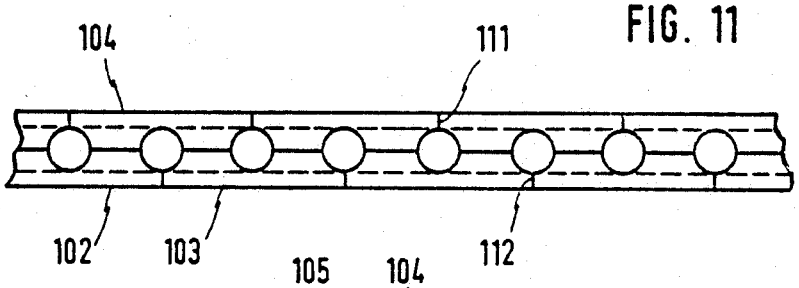
Figure 12:
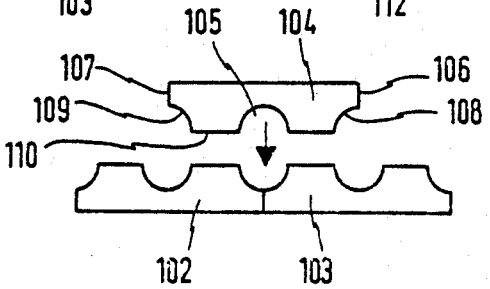

The drawing shows, by way of example, a plurality of embodiments of the invention; these embodiments will be described in detail hereinbelow; the individual figures show the following things:

FIG. 1 an oblique view of an erected large-panel component for buildings,

FIG. 2 a section along line 2—2 in FIG. 1,

FIG. 3 an oblique view of another embodiment of the large-panel component for buildings, FIG. 4 a section along line 4—4 in FIG. 3, FIG. 5 a top view of an area of several joined semi-panels, FIG. 6 an enlarged section through a portion of a panel element, FIG. 7 a section, similar to that shown in FIG. 6, through another embodiment of a panel element, FIG. 8 an oblique view of another embodiment of a large-panel component for buildings, FIG. 9 a detail of a connection between a large panel-component and a ceiling beam, FIG. 10 an oblique view of a modified embodiment, FIG. 11 a section along line 11—11 in FIG. 10 and FIG. 12 an enlarged view of a production scheme for the large-panel component according to FIG. 10.

A large-panel component for buildings 1 consists of semi-panels 2 which are glued together such that they are offset relative to one another. Each semi-panel is provided with a central, vertical cavity 3 and with equally spaced cavities 4, which extend at right angles to said cavity 3, as well as with semi-cavities 5 and 6, respectively, which are provided at the end faces.

The large-panel component for buildings is joined e.g. on a table or rack, the semi-panels being glued together in the course of said joining operation.

As can be seen from FIG. 2, the vertical cavities 3 have inserted therein reinforcement cages 10, which each comprise three longitudinal iron bars 11, 12 and 13 and which are interconnected by a helical transverse reinforcement.

It is not absolutely necessary, but in many cases it will be expedient to provide the transversely extending cavities 4 with individual iron bars 14 extending transversely across the large-panel component for buildings; the large-panel component may e.g. have a floor-to-floor height of 2.50 m, the individual strip-shaped semi-panels having a thickness of 10 cm and a width of 75 cm each. It follows that the large-panel component shown has a width of 4.50 m.

A shoulder 15 is already provided in the manufacturing plant so that prefabricated ceiling units can be attached. In addition to the adhering joints 16 extending perpendicular to the plane of the wall, there is also an adhering joint 17, which extends centrally in the plane of the wall and which interconnects the semi-panels.

Whereas, as has already been mentioned, the reinforcement iron bars are inserted in the manufacturing plant, it may in certain cases also prove to be expedient when the intersecting cavities 3 and 4 are already filled with a filling material, e.g. with cast concrete, in the manufacturing plant. The dash lines indicate a window 18 to be cut out on a later date.

In the case of the embodiment according to FIGS. 3 and 4, a large-panel component for buildings 20, which has the same dimensions as the large-panel component described hereinbefore, is composed of semi-panels 21 in such a way that the transversely extending joints 22 are located in the same cross-sectional plane of the panel component, as can be seen from FIG. 4. In this case, too, the individual semi-panels are glued together not only at the transverse joints but also at the central joint 23.

For the purpose of simplifying the reinforcement, a reinforcement network 24 has, in the present case, been inserted into the semi-cavities of the horizontally positioned semi-panels prior to attaching the second layer of semi-panels, said reinforcement network consisting of longitudinal and transverse iron bars which are welded together.

As can be seen from FIG. 6, this reinforcement network is held approximately in the centre of the cavities 3 and 4, respectively, by means of spacers 25. These spacers may consist e.g. of a star, which is composed of individual pieces of wire arranged in a star-shaped pattern.

In FIG. 7, the reinforcement of the cavities 3 by means of the reinforcement cage 10 is shown in an enlarged view.

In FIG. 8, the large-panel component for buildings shown in FIG. 3 is provided with a rectangular opening or recess 30, which extends through the large-panel component and which is to be used as a window, subsequently. The recess 30 is covered by laths or boards 31 on all lateral surfaces thereof so as to prevent the filling material, e.g. cast concrete, from flowing into the recess during the subsequent filling out of the cavities 3 and 4. The reinforcement of the large-panel component 20 is not shown in FIG. 8, but said reinforcement should nevertheless be provided even though, in particular in the case of single-story buildings, the load-bearing capacity of the light-weight concrete, e.g. polystyrene concrete, will be sufficient for carrying also the ceiling beams on the shoulder 32.

In the case of the embodiment according to FIG. 8, too, the cavities 3 and 4 are only filled on-site.

The reinforcement provided is not only provided for statical reasons concerning the finished building, but it is also provided as a support of the large-panel component in the transport position, i.e. in the horizontal position.

Instead of the through-hole 30 provided, it is also possible to provide a blind opening having the same dimensions; said blind opening extends over approx. $\frac{3}{4}$ of the depth of the panel component, but will comprise the entire cavities in any case. This blind opening or blind recess is sawn out or cut out in-situ. For producing said blind opening or blind recess, milling cutters may be employed.

A modified embodiment of the preparation of openings, e.g. window openings, is shown in FIG. 9.

The large-panel component for buildings 40, which has already been erected, carries a ceiling beam 41 and is provided with a slot 42 on the level of the upper edge of the window opening. This slot need not extend through the whole panel component, but it should be cut in to such an extent that the area of the cavities 3 and 4, respectively, is fully included. The slot has inserted therein a board 43, which prevents the filling material from flowing into the area of the future opening. Corresponding slots and boards are also provided on the two lateral edges of the future openings.

The lower edge of the future opening 44 is provided with a wedge-shaped aperture 45 so that the filling material, e.g. the cast concrete, can be introduced from this location into the cavities positioned below said aperture.

It is obvious that the boards 43 and the wedge-shaped slot 45 can be inserted and provided, respectively, already on the table in the manufacturing plant.

For a modified mode of producing a large-panel component for buildings 100, semi-panels 102, 103 and 104, respectively, are used, said semi-panels having a height which corresponds to the floor-to-floor height, i.e. e.g. 2.50 m, and being each provided—as can be seen from FIG. 12—with a continuous semi-cavity 105 and with quarter-cavities 108 and 109, respectively, provided on the end faces 106 and 107 of said semi-panel. Such semi-panels are produced in the conventional manner and are then positioned side by side on a table or on another flat, horizontal surface.

In the case of the embodiment shown, five complete semi-panels and, at both end faces, longitudinally divided half semi-panels have been positioned side by side.

Subsequently, the respective projecting surfaces 110 on the juxtaposed semi-panels 104 have applied thereto by means of spraying a polyurethane isocyanate adhesive, which, as is generally known, foams up after some seconds, e.g. after 15 to 18 seconds.

Prior to this foam formation, six semi-panels 102 and 103 have been attached to the layer of semi-panels—as can be seen from FIG. 11—in an overlapping manner. Although the respective cavities produced can also be poured out or filled up with a casting material, e.g. concrete, in the manufacturing plant, it will be more expedient to pour out said cavities in-situ when the wall has been erected.

As will be particularly evident from FIG. 11, the respective joints 111 and 112 of juxtaposed semi-panels are arranged in such a way that not a single joint extends rectilinearly through the wall.

As indicated by dash lines 120, windows and doors may be cut out of the wall before said wall leaves the plant; it will, however, be expedient if this is done subsequent to the filling up of the cavities with the casting material, i.e. selectively in the manufacturing plant of on-site.

As is generally known, the light-weight building material used, e.g. polystyrene concrete, can be treated comparatively easily by means of conventional tools; it can, for example, be sawn, chiseled out or treated in some other way.

In order to further faciliate the prefabrication of the large-panel component for buildings, it is possible to provide, on the side of the ceiling, a milled out portion 121, as shown in the figure, whereby the support for ceiling elements, ceiling beams or the like is already provided in the manufacturing plant. Also this milling out or cutting out should then expediently be carried out in the manufacturing plant.

The connection of additional panel components, composed in a manner corresponding to or similar to the manner described hereinbefore, is then effected on-site in the usual way by using corner pieces or the like.

It is also possible to use broader semi-panels, as far as this can be done from the point of view of production technology, said broader semi-panels comprising e.g. two or, if desired, even more semi-cavities which extend parallel to one another in the longitudinal direction of the semi-panel. However, when the semi-panels are assembled to form a large-panel component for buildings, it will always be necessary to take into account that the individual semi-panels have to be arranged in an overlapping mode of arrangement.

Finally, reference is made to the fact that the half semi-panels, which are provided at the respective end faces, are produced simply by cutting through the semi-panels 102, 103 or 104 in the middle of the semi-cavity.

I claim:

1. A method of constructing building walls and the like comprising the steps of:

(a) forming a plurality of lightweight rectangularly-shaped panels constructed using a mixture of polystyrene and concrete, one surface of said panels having a plurality of evenly spaced vertical semicircular cavities extending in parallel across the length dimension of said panel, the outermost cavities comprising quartercircular cavities; and further horizontal semicircular cavities extending along the same surface in a spaced and parallel relation across the width dimension of the panel, (b) inserting reinforcing bars in a plurality of said semicircular cavities on said at least one of said panels, (c) bonding a pair of said panels in facing alignment such that each panel's horizontal and vertical semicircular cavities are aligned to form a plurality of circular cavities, (d) bonding a plurality of said pairs of panels in end-to-end alignment such that said horiontal cavities are in communicating relation with each other to form a large panel component, (e) cutting an opening in said large panel component, said opening being of predetermined dimensions, (f) covering on all lateral cut surfaces of said opening, (g) transporting said large panel component to a construction site, and (h) pouring concrete into said horizontal and vertical cavities at said construction site.

2. The method of constructing building walls of claim 1, wherein said reinforcing bars are inserted into both the horizontal and vertical semicircular cavities.

3. The method of constructing building walls of claim 1, wherein said opening comprises of a blind opening having transverse slots across the width dimension of one or more panels, the depth of such slot extending at least through said cavities.

4. The method of constructing a building wall of claim 3, wherein said blind opening further comprises a V-shaped slot beneath said transverse slot, said V-shaped slot extending across the width dimension of one or more panels and having a depth extending at least into said cavities.

5. The method of constructing a building wall of claim 1, wherein spacers are attached to said reinforcing bar in contacting relation with said circular cavities so as to center said reinforcing bars in said circular cavities.

6. The method of constructing a building wall of claim 1, wherein said spacers further comprise a star-shaped structure which is attached to said reinforcing bars and said spacers having radial segments projecting therefrom.

7. The method of constructing a building wall of claim 1, wherein said pair of panels are bonded in an overlapping alignment such that successive pairs of bonded panels are arranged successively in a non-aligned manner and said bonded pair of panels extending beyond the side edge of the opposite paired panel.

* * * * *

UNITED STATES PATENT AND TRADEMARK OFFICE

CERTIFICATE OF CORRECTION

PATENT NO. : 4,731,971

DATED : March 22, 1988

INVENTOR(S) : Hans-Ulrich Terkl

It is certified that error appears in the above-identified patent and that said Letters Patent is hereby corrected as shown below:

Title page:

Delete the entire Abstract as shown in the printed patent and substitute therefor the following Abstract:

-- A prefabricated wall section is made from a lightweight mixture of concrete and polystyrene material, including panel sections having regularly spaced parallel semicircular cavities along one surface extending in both the width and length directions of the panel. Reinforcing bars are placed within the cavities, with spacers for centering the reinforcing bars, and the panel sections are then placed in facing alignment to provide a plurality of interior horizontal and vertical cavities for receiving and containing structural concrete. After transportation to the site, concrete is poured into the interior cavities. --

In column 5, line 37, "of" should be -- or --.

Signed and Sealed this

Ninth Day of August, 1988

*Attest:*

*Attesting Officer*

DONALD J. QUIGG

*Commissioner of Patents and Trademarks*